US005492326A

United States Patent [19]

Takemoto et al.

[11] Patent Number: 5,492,326

[45] Date of Patent: Feb. 20, 1996

[54] GAME MACHINE ISLAND

[75] Inventors: Takatoshi Takemoto; Koichi Tsubota, both of Tokyo; Hideyuki Kadomatsu, Odawara; Etsurou Sasaki, Kawasaki, all of Japan

[73] Assignee: Kabushiki Kaisha Ace Denken, Japan

[21] Appl. No.: 266,329

[22] Filed: Jun. 27, 1994

[51] Int. Cl.[6] ..... A63F 7/02

[52] U.S. Cl. ..... 273/118 R; 273/118 A; 273/121 B

[58] Field of Search ..... 273/121, 118

[56] References Cited

FOREIGN PATENT DOCUMENTS

| | | | |
|---|---|---|---|
| 2-243440 | 9/1990 | Japan . | |
| 0021285 | 1/1991 | Japan | 273/121 B |
| 403242187 | 10/1991 | Japan | 273/121 B |
| 093006902 | 4/1993 | WIPO | 273/121 B |
| 094019077 | 9/1994 | WIPO | 273/121 B |

*Primary Examiner*—Raleigh W. Chiu
*Attorney, Agent, or Firm*—Andrus, Sceales, Starke & Sawall

[57] ABSTRACT

A game machine island comprising ball lending machines each disposed between two adjoining game machines and ball lending machines of the same type arranged at the ends of the line of the game machines, respectively. A drive unit and a driven unit have introducing paths communicating with bank note discharging slots of the ball lending machines arranged at the ends of the island, respectively, for directly introducing bank notes discharged from the ball lending machines to the conveying belt. In the construction of the island, the installation and the wiring is carried out efficiently, and the workability of the installation can be enhanced, and the cost can be reduced.

6 Claims, 10 Drawing Sheets

GAME MACHINE ISLAND

FIELD OF THE INVENTION

The present invention relates to a game machine island having a bank note conveying apparatus which conveys bank notes at the rear side of the island. The game machine island is arranged so that a plurality of game machines extend side by side, to right and left sides, so as to form a line of game machines,

DESCRIPTION OF THE RELATED ART

A conventional game machine island is as shown in FIGS. 9, 10A and 10B.

As shown in FIG. 9, the game machine island 1 comprises a plurality of pachinko machines 2 arranged side by side. A conveying apparatus 3 is provided, behind a line of pachinko machines 2*a*. A ball lending machine 4 is disposed between each adjoining pachinko machines and another type of ball lending machines 5 are arranged at ends of the line of pachinko machines 2*a*, respectively.

The conveying apparatus 3 comprises: a drive pulley 3*a*, provided at one end of the line of pachinko machines 2*a*; a driven pulley 3*b*, provided at the other end of the line of pachinko machines 2*a*; a conveying belt 3*c* placed over the drive pulley 3*a* and the driven pulley 3*b*; and a conveying path formed along a tension side of the belt 3*c*.

In order to pass a bank note through a discharging slot of the ball lending machine 4 to the conveying path, an introducing unit for the introduction of the bank notes (not shown) should be provided between the ball lending machine 4 and the conveying path. But there is no space for providing the introducing unit at both ends of the line of pachinko machines 2*a*. The ball lending machine 4 cannot be provided for the use of a bank note. So, at the end of the line of pachinko machines 2*a*, the ball lending machine 4, as shown in FIG. 10A, cannot be provided for both coin and bank notes, and only coin operated ball lending machines 5 exists, as shown in FIG. 10B.

In the conventional game island 1, two types of ball lending machines are used, one type between the pachinko machines 2 and another at the ends of the pachinko island. As a result, the construction and the wirings suitable for two types of ball lending machines are required. Thereby, installation is troublesome, takes longer time, and becomes expensive.

Further, when a player sits at the end of the pachinko island, he cannot use bank notes for the ball lending machine 5. However, the machine may be used incorrectly or inadvertently by inserting bank notes into a coin only operated ball lending machine 5.

SUMMARY OF THE INVENTION

The present invention is made in view of the problems involved in the conventional game machines. The object of the invention is a game machine island with efficient installation and wiring thereby enhancing ease of construction, reducing the cost of construction and eliminating incorrect machine usage where the player is no longer able to insert bank notes into the coin only operated ball lending machine.

In order to accomplish the above mentioned object, the present invention provides a game machine island with a plurality of game machines arranged side by side, and a bank note conveying device provided behind a line of game machines, for conveying a bank note into a main conveying direction. The game machine island includes a bank note conveying device comprising a drive unit having a drive pulley provided at one end of the line of game machines, a driven unit having a driven pulley provided at the other end of the line of game machines and a conveying belt placed over the drive pulley and the driven pulley and being circulated in the main conveying direction; a ball lending machine which allows the use of bank notes disposed between each game machine and at least at one of the ends of the line of game machines; and an introducing path provided at the drive unit and/or the driven unit in accordance with the installation of the ball lending machine provided at at least one of the ends of the line of game machines, thereby allowing a bank note discharged from the nearby ball lending machine to travel to the belt.

At both ends of the line of the game machines, plates may be provided. On the plate, installing brackets may be fixed for adjustably supporting the drive unit or the driven unit which is slidably mounted on the installing brackets. The drive unit and/or the driven unit is slidably mounted on the installing brackets. A connecting guide is provided for adjusting the position of an inlet of an introducing path, so that it is in accord with the position of the discharging slot of the ball lending machine.

When the game machine island is constructed, the ball lending machines which allow the use of bank notes are each disposed between any adjoining two game machines in line. The same type of ball lending machine may be disposed at least at one of the ends of the line of game machines if necessary. The ease of construction and the wiring construction are enhanced, because the same type of ball lending machines are disposed between game machines and at the end of the line of the game machines.

At the rear of the line of game machines, a bank note conveying device is provided for conveying bank notes inserted in each of the ball lending machines to the main conveying direction. When constructing the bank note conveying device, first, a drive unit having a drive pulley is provided at one end of the line of game machines and a driven unit having a driven pulley is provided at the other end.

A belt is placed over the drive pulley and the driven pulley, circulating in a conveying direction along a main conveying path. A means for transporting the bank note discharged from the ball lending machine to the conveying path is needed in order to convey the bank note discharged from the ball lending machine in the main conveying direction while letting the bank note contact the belt.

The rear of each game machine-has a space between the discharging slot of the ball lending machine disposed between the game machines and the main conveying path where the belt runs. In this space, a special unit can be inserted for transporting a bank note discharged from the ball lending machine to the conveying path.

At the end of the line of the game machines there is no space for provision of the special unit. Therefore, the discharging slot of the ball lending machine is communicated with the introducing path provided at the drive unit or the driven unit near the bank note discharging slot. In this construction, without providing a special unit, a bank note discharged from the ball lending machine arranged at the end of the island where there is little space is transported directly to the conveying belt in the conveying direction.

Further, in the game machine island, the plates forming the end portion of the island at both ends of the line of game machines are provided. The installing brackets may be fixed on each of the plates for supporting the drive unit or the driven unit, allowing adjustment in the main conveying direction.

In the present invention, the connecting guide is provided at the unit provided at least one end of the line of the game machines The connecting guide is slidably fitted onto the installing brackets to adjust the position of the entrance of the introducing path of the unit so as to communicate with the discharging slot of the ball lending machine. In such a manner, the drive unit and/or the driven unit can change their position easily to their optimum position where the bank note may be directly introduced from the discharging slot of the ball lending machine at the end of the island, to the belt,

DETAILED DESCRIPTION OF THE PREFERRED EMBODIMENT

An embodiment of the present invention will be described with reference to the drawings.

FIGS. 1 to 8 show one embodiment of the present invention.

Figure 2:
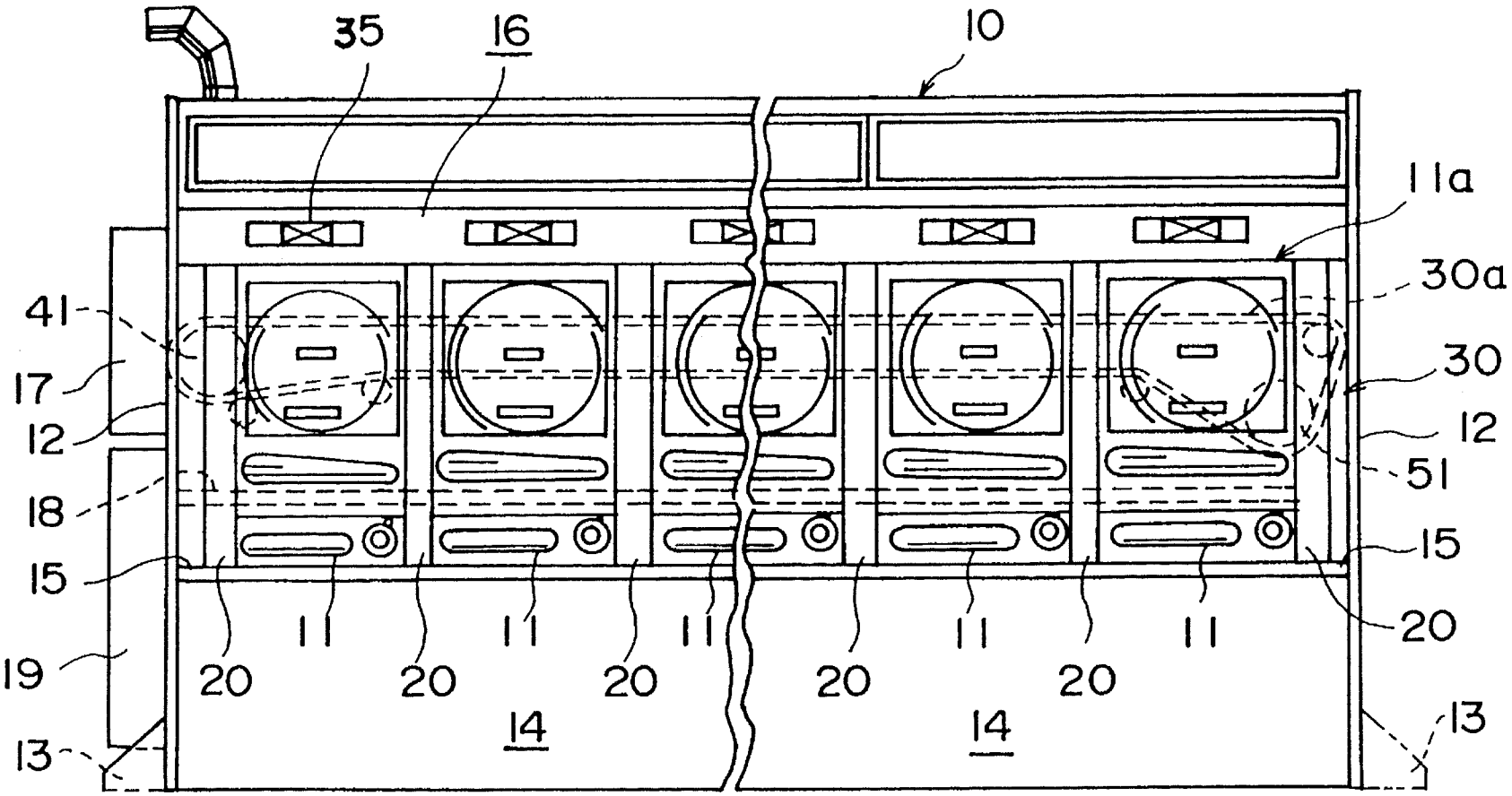
FIG. 2 is a front view of a game machine island according to the present invention.

As shown in FIG. 2, a game machine island 10 is formed by a line of game machines 11*a*, in which the game machines 11 are arranged side by side in line. In the line of game machines 11*a*, ball lending machines 20 are each disposed between game machines 11, respectively. At both ends of the line of game machines 11*a*, the same type of the ball lending machines 20 are arranged.

The game machines 11 and the ball lending machines 20 are provided on upper surface of a top board 15 fixed on the top end of a skirt board 14 provided at a lower portion of the island. On a floor of a game parlor, plates 12 are arranged to stand by holding brackets 13. The skirt board 14 and the top board 15 are provided at the lower portion between tile plates 12. On the upper portion between the plates 12, a curtain board 16 is mounted installing display lamps 35 each corresponding to the game machines 11, respectively.

At the upper portion behind the line of game machines 11*a*, a bank note conveying device 30 is provided. The bank note. conveying device 30 receives a bank note discharged from the ball lending machine 20, conveys the bank note along a bank note conveying line (a main conveying path) and collects the bank note into a bank note collecting device 17 fixed at one of the plates 12. Under the bank note collecting device 17, a coin collecting device 19 is also fixed to the same plate 12. Along the lower portion behind the line of game machines 11*a*, a coin conveying line 18 is provided for sending coin discharged from the ball lending machines 20 to the coin collecting device 19.

Figure 3:
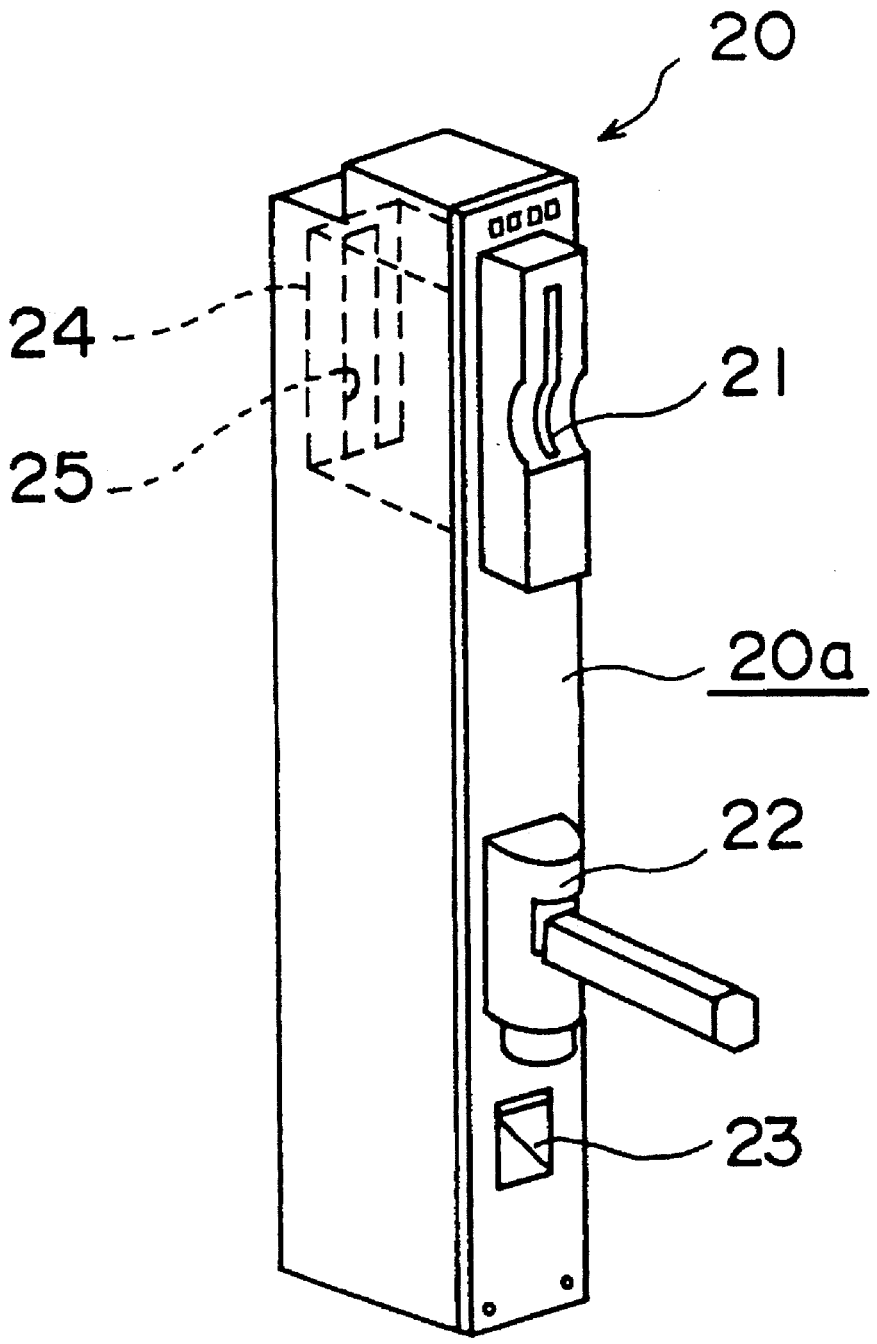
FIG. 3 is a perspective view of a ball lending machine disposed in the game machine island according to the present invention.

The ball lending machine 20 is formed in a rectangular shape, as shown in FIG. 3. On the upper portion of a front face 20*a* of the machine 20, there is a bank note/coin insert slot 21, and the lower portion of the front face 20*a* has a ball pot 22 and a coin repayment pot 23. Inside the bank note/coin insert slot 21, a bank note identifying machine 24 having a bank note examining unit is provided, A bank note discharging slot 25 opens on the back face of the bank note identifying machine 24.

As shown in FIG. 2, the bank note conveying device 30 has a drive pulley 41 provided at one end of the line of game machines 11*a*, a driven pulley 51 provided at the other end of the line of the game machines 11*a*, a round belt 30*a* is placed over the drive pulley 41 and the driven pulley 51 for circulating and conveying a bank note. A tension side (the upper side of 1he belt between pulleys 41 and 51) of the belt 30*a* extends along the bank note collecting line.

Figure 1:
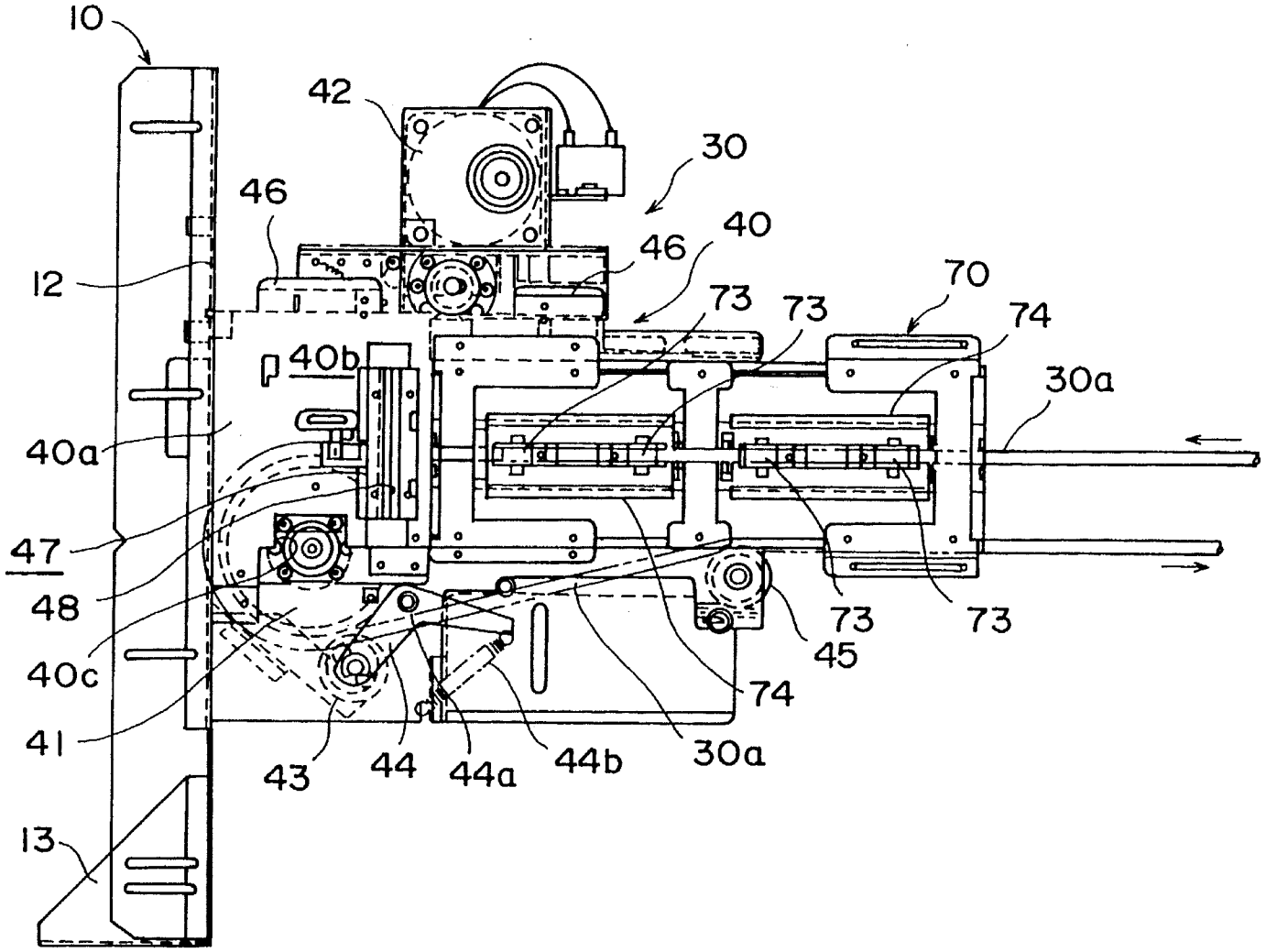
FIG. 1 is a front view of a drive unit constructing a bank note conveying device in the game machine island according to the present invention.

As shown in FIG. 1, at one end of the bank note collecting line, a drive unit 40 having a drive pulley 41 for circulating the round belt 30*a* is provided. The drive unit 40 comprises a drive unit installing frame 40*a* fixed to the plate 12, an electric motor 42 provided on the drive unit installing frame 40*a* and the drive pulley 41 driven by the electric motor 42 via a transmission mechanism. The drive pulley 41 is placed in a pulley installing unit 40*c* which is at the lower portion of the drive unit installing frame 40*a*.

Figure 4:
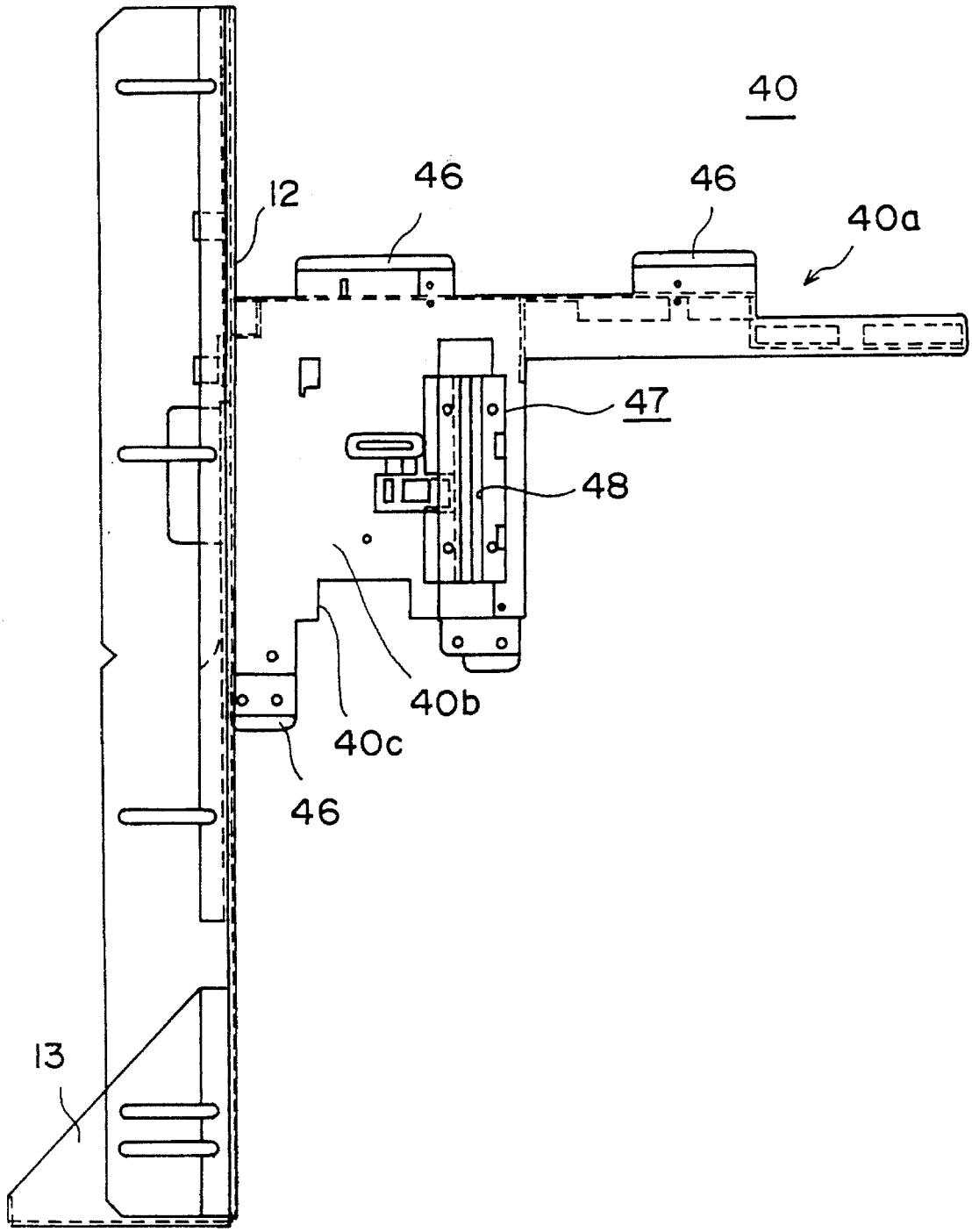
FIG. 4 is a front view of a drive unit frame constructing a bank note conveying device of the game machine island according to the present invention.
Figure 5:
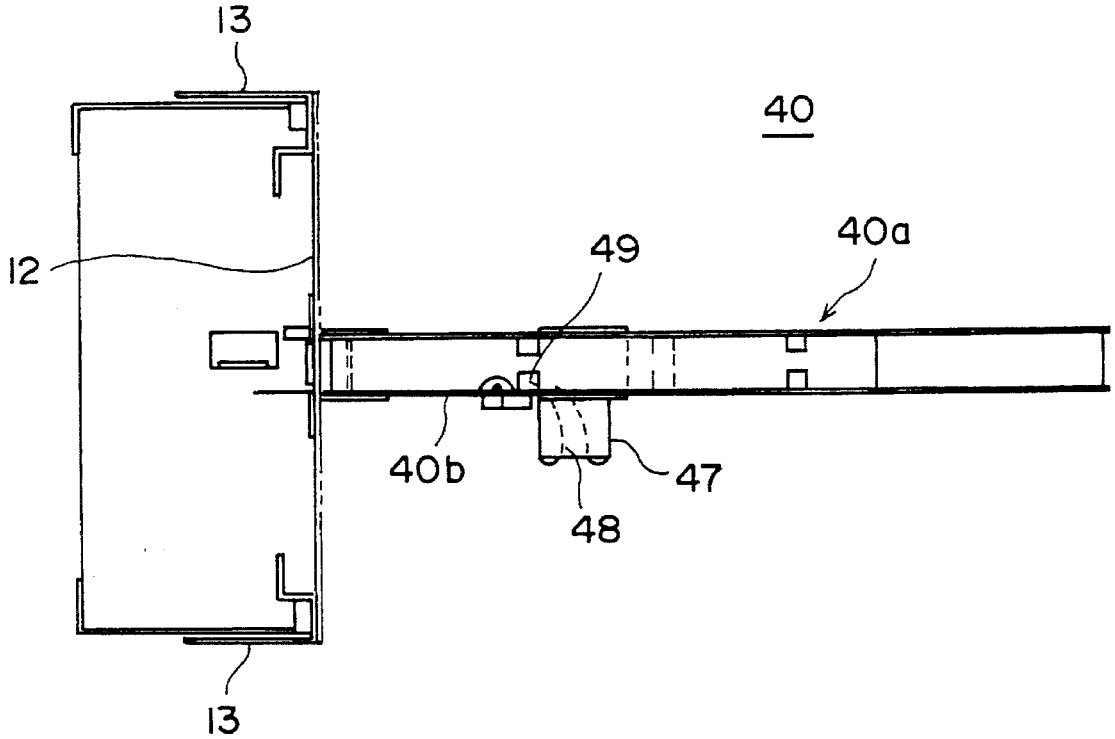
FIG. 5 is a plan view of a drive unit frame constructing a bank note conveying device of the game machine island according to the present invention.

As shown in FIGS. 4 and 5, the drive unit 40 is formed and structured as shown. At both upper and lower ends of a wall 40*b* of the drive unit installing frame 40*a*, connecting guides 46 are provided. The connecting guides are slidably mounted and positioned so that they may be adjusted in a longitudinal direction in installing brackets 55, 56 (shown in FIG. 6) fixed on the plate 12. The positioning of the installing brackets 55, 56 and the drive unit installing frame 40*a* can be adjusted with respect to the plate 12.

On the wall 40*b* of the drive unit installing frame 40*a*, an introducing path assembly 47 is communicated with the bank note discharging slot 25 (shown in FIG. 3) of the ball lending machine 20 arranged at the left end of the line of game machines 11*a* in FIG. 2, for directly introducing the discharged bank note to the round belt 30*a*.

As shown in FIGS. 4 and 5, the introducing path assembly 47 has a funnel-shaped bank note introducing path 48 (rectangular in section extending vertically). The path 48 is formed by an opening whose width is reduced along the passage, and shaped to curve from the front to the rear of the introducing path assembly 47 so as to gradually direct to the main conveying direction. At a part of a rim of the exit of the bank note introducing path 48 which opens on the back face of the introducing path assembly 47, there is a guide board 49 for transporting a bank note from the bank note introducing path 48 to the round belt 30*a*. One end of the main conveying path is constructed by the guide board 49 and the drive unit installing frame 40*a*.

At the lower portion of the drive pulley 41, as shown in FIG. 1, there is a bias pulley 43 supported pivotally at one end of an L-shaped arm assembly 44. The drive pulley 41 and the bias pulley 43 rotatably hold the round belt 30*a*, and the bias pulley 43 presses the round belts 30*a* against the drive pulley 41.

The arm assembly 44 is supported pivotally at almost the center of the L-shaped body. The arm assembly 44 is biased by a coil 44*b* connected to the other end of the the arm assembly 44, so that the biasing pulley 43 is urged towards the drive pulley 41. In the vicinity of the arm assembly 44, there is a guide pulley 45 for guiding the initial end of the slackened side of the round belt 30*a* along the bottom end of a conveying unit 70.

Figure 6:
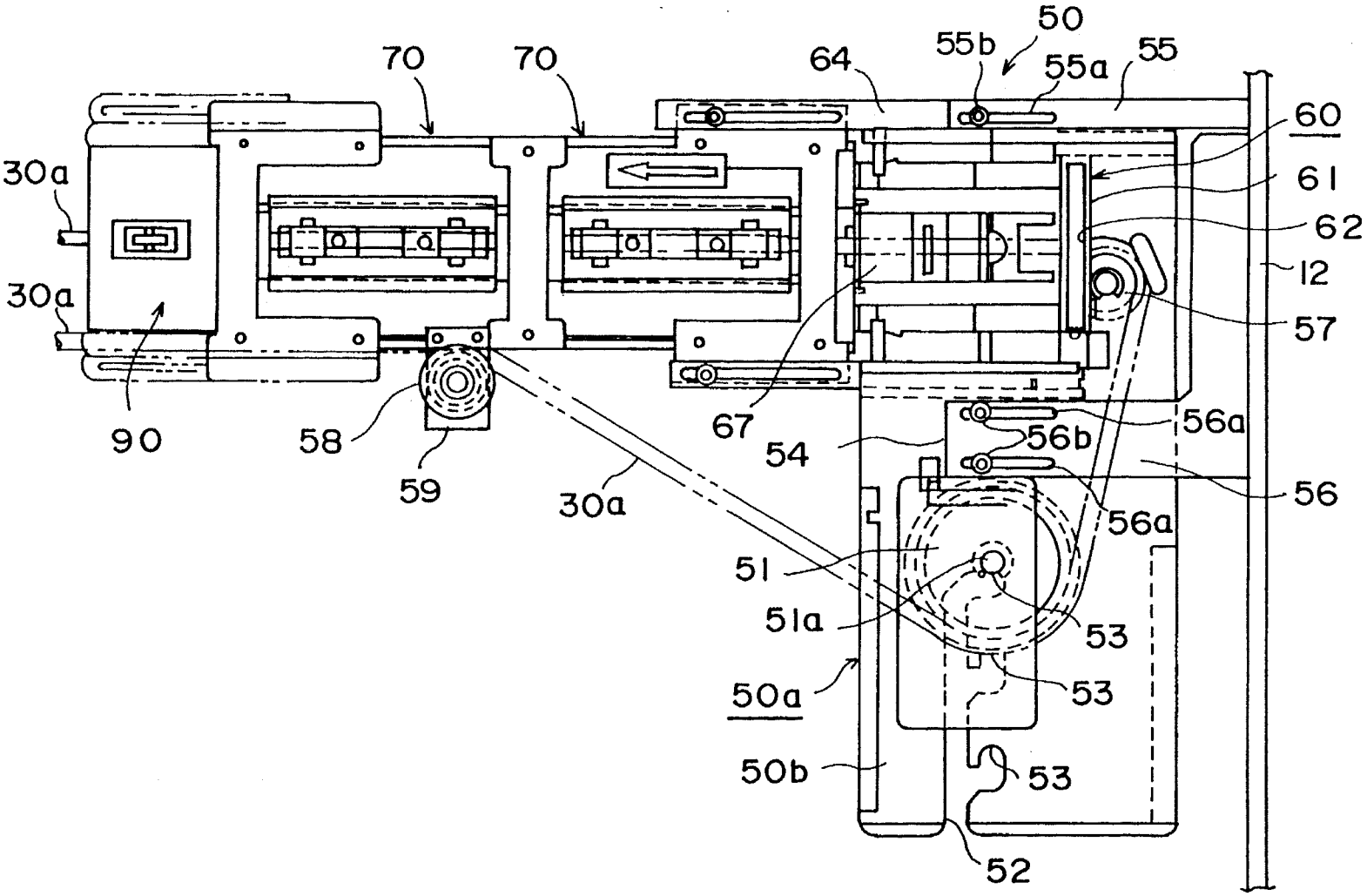
FIG. 6 is a front view of a driven unit constructing a bank note conveying device of the game machine island according to the present invention.

As shown in FIG. 6, at the other end of the bank note collecting line, there is connected a driven unit 50 having a driven pulley 51 placed over the round belt 30*a*. The driven unit 50 comprising a driven unit installing frame 50*a* movably attached to the plate 12 via a lower installing bracket 56 and an introducing path supporting body 60 which can adjust its installing place with respect to the driven unit installing frame 50*a*.

Both an upper installing bracket 55 and tile lower installing bracket 56 are fixed to the plate 12. On the lower installing bracket 56, two elongated holes 56*a* are formed in parallel to each other in a vertical relationship. Connecting screws 56*b* are screwed into the connecting guide 54 of the driven unit installing frame 50*a* through the long holes 56*b* of the lower installing bracket 56. The position of the driven unit installing frame 50*a* can be changed within the length of the long hole.

On a wall 50*b* of the driven unit installing frame 50*a*, which pivotally supports the driven pulley 51, a groove 52 is formed for adjusting the tension of the round belt 30*a* by allowing the place of the shaft of the driven pulley 51 to change. In the groove 52, three branched grooves 53 are formed so that the place of the shaft of the driven pulley 51 may change. In FIG. 6, the shaft 51*a* is placed in the top branch groove 53.

At right and upper portion of the driven pulley 51, the mini-driven pulley 57 is pivotally supported to let the round belt 30*a* placed over the driven pulley 51 go along the bank note collecting line extending horizontally at the rear of the line of the game machines 11*a*. Further, under a conveying unit 70 connected to the drive unit 50, a guide pulley 58 is provided via a supporting bracket 59 in order to let the end portion of the slackened side of the round belt 30*a* extend in parallel to the bottom of the conveying unit 70.

Figure 7:
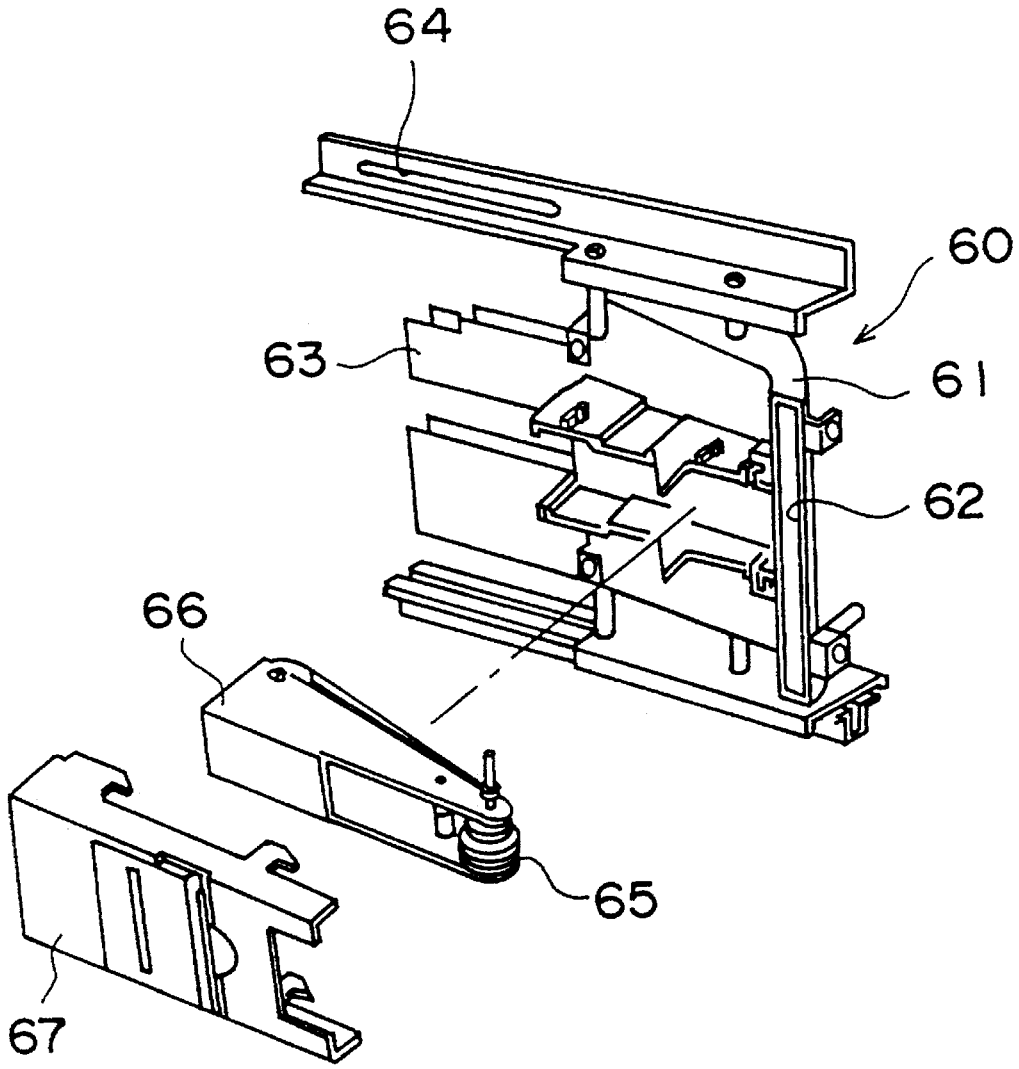
FIG. 7 is a perspective view of a introducing path supporting body of the driven unit of a bank note conveying device of the game machine island according to the present invention.

As shown in FIGS. 6 and 7, the introducing path supporting body 60 which constitutes a part of the driven unit 50 has an introducing path assembly 61. The introducing path assembly 61 is communicated with the bank note discharging slot 25 (refer to FIG. 3) of the ball landing machine 20 arranged at the right end of the line of the game machines 11*a*, and introduces a bank note discharged from the discharging slot 25 to the round belt 30*a*.

The introducing path assembly 61 is curved to the bank note collecting line. At the exit of a bank note introducing path 62 in the introducing path assembly 61, a guide board 63 is installed for letting a bank note travel along the round bell 30*a*. In front of the introducing path supporting body 60, a chute case 66, having a drive roller 65, and a chute cover 67, are provided.

At the top end of the introducing path supporting body 60, there is a connecting guide 64. The connecting guide is slidably fitted with the upper installing bracket 55 fixed to the plate 12. On the upper installing bracket 55, an elongated hole 55*a* is formed for allowing a connecting screw 55*b* to pass therethrough. At the connecting guide 64 of the introducing path supporting body 60, the screw 55*b* passing though the hole 55*a* of the upper installing bracket 55 is screwed so that the position of the introducing path supporting body 60 may be adjusted in a lateral direction as viewed in FIG. 6, namely in the conveying direction.

Figure 8:
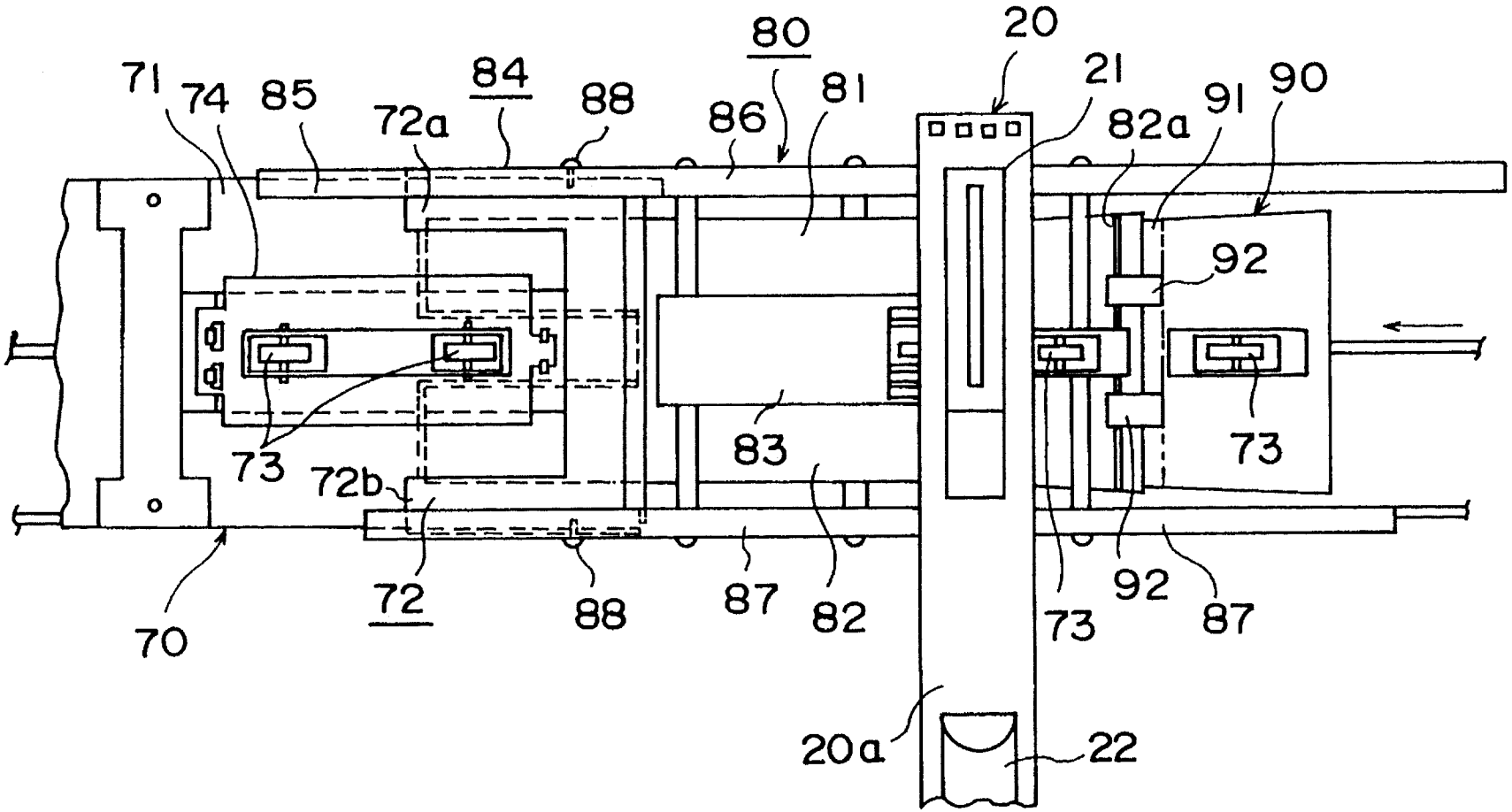
FIG. 8 is a front view of a part of a bank note conveying device of the game machine island according to the present invention.
Figure 9:
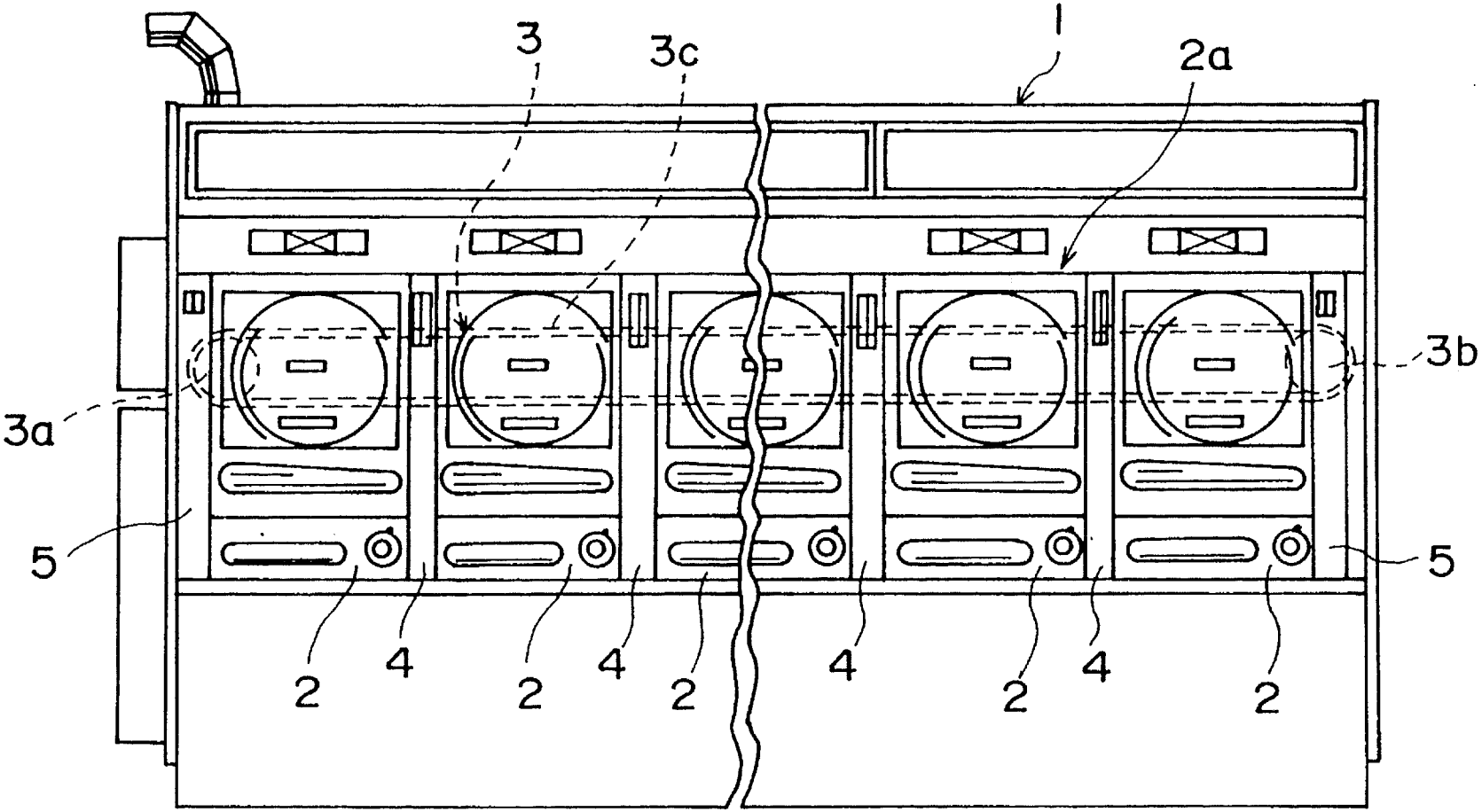
FIG. 9 PRIOR ART
FIG. 9 is a front view of a conventional game machine island.
Figure 10A:
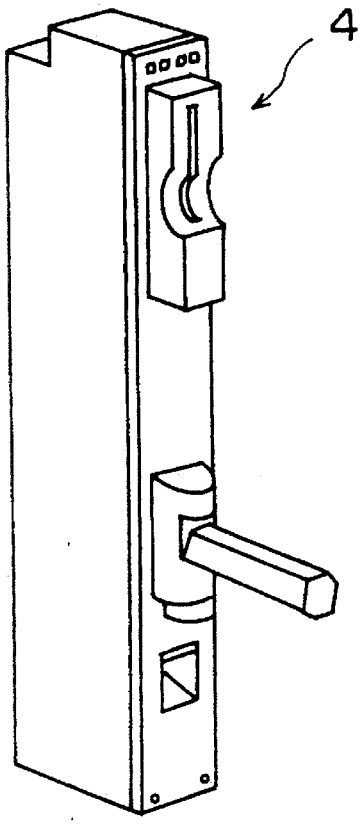
FIG. 10 A PRIOR ART
FIGS. 10A and 10B are perspective views of ball lending machines disposed in the conventional game machine island, respectively.
Figure 10B:
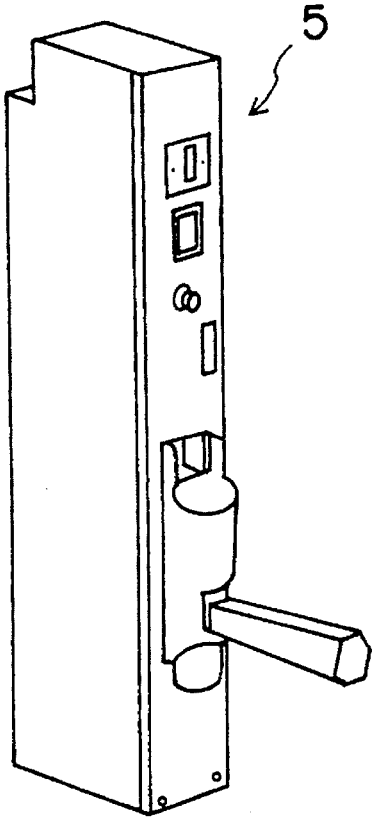
FIG. 10 B PRIOR ART

As shown in FIGS. 2 and 8, the bank note collecting line is communicated with the bank note discharging slots 25 of the ball lending machines 20 disposed between the game machines 11 by introducing units 80 connected to the intermediate conveying units 70, and length adjustment units 90, if desired. The intermediate conveying units 70 convey a bank note to the bank note collecting device 17, and form intermediate portions, i.e. intermediate conveying path assemblies. The introducing unit 80 and the intermediate conveying unit 70 are connected to each other in such a manner; that the relative position may be changed in the conveying direction.

As shown in FIG. 8, the intermediate conveying unit 70 is provided, for example, by fixing joint members 72 at the top and bottom ends of a intermediate conveying path assembly 71 made of a plastic resin, and pairs of conveying rollers 73 provided where necessary. The number of the pairs is changed according to necessity. The pairs of conveying rollers 73 are supported pivotally at a roller installing board 74 mounted on the intermediate conveying path assembly 71. The joint members 72 are placed over the top and bottom ends of the intermediate conveying path assembly 71. An upper connecting rail 72*a*and a lower connecting rail 72*b* are formed at the upper and lower faces of the joint member 72, respectively.

The introducing unit 80 is formed by a conveying path 82 extending in the conveying direction of the round belt 30*a*, and an introducing path 83 communicating the bank note discharging slots 25 of the ball lending machines 20 with the conveying path 82. The introducing path assembly 81 is held by a connecting guide member 84.

The connecting guide member 84 has a guide rail 85 fitted over the upper connecting rail 72*a* of the joint member 72 of the intermediate conveying unit 70, to be fixed to an upper guide 86. The connecting guide member 84 further has a lower guide 87 which contacts the bottom of the lower connecting rail 72*b* of the joint member 72.

The guide rail unit 85 and the lower guide 87 each have an elongated hole (not shown) to pass a connecting screw 88, therethrough.

The intermediate conveying unit 70 and the introducing unit 80 are connected to each other by placing the connecting guide 84 of the introducing unit 80 ever the joint member 72 of the intermediate conveying unit 70, and by fitting the end of the conveying path 82 of the introducing path assembly 81 of the introducing unit 80 in the intermediate conveying assembly 71 of the intermediate conveying unit 70. When the connecting screw 88 loosens, the location of the intermediate conveying unit 70 and the introducing unit 80 may be changed within the length of the hole.

As shown in FIG. 8, the length adjustment unit 90 has, at its end, a connecting portion 91 placed over the end of the conveying path 82 of the introducing path member g 1 of the introducing unit 80. At the connecting portion 91, hooks 92 are provided for engaging with steps 82*a* provided at the end of the conveying path 82. At the middle of the length adjustment unit 90, a pair of conveying rollers 73 are provided.

The round belt 30*a* extends between each pair of rollers 73 in the bank note collecting line which is constituted by the introducing units 80, the intermediate conveying units 70, and the length adjustment units 90, The operation will now be described.

As shown in FIG. 2, when the game machine island constructed, the ball lending machines 20 are each disposed between any two adjacent game machines 11 arranged side by side in line and the ball lending machines 20 of the same type are arranged at both ends of the line of game machines 11*a*. Thus, the ball lending machines for installing in the game machine island are standardized to one type only, thereby enhancing ease of installation and wiring construction.

At the rear side of the line of the game machines 11*a*, the bank note conveying device 30 is provided for receiving the bank noes inserted in the ball lending machines 20, and conveying the bank notes along the bank note collecting line to collect the bank note in the bank note collecting device 17. The bank note conveying device 30 is constructed by first disposing the drive unit 40 having the drive pulley 41 at one end of the line of game machines 11*a* as shown in FIG. 1, and then disposing the driven unit 50 having the driven pulley 51 at the other end of the line of game machines 11*a* as shown in FIG. 6.

As shown in FIGS. 1 and 4, the drive unit 40 has the connecting guide unit 46 which is slidably fitted to the installing bracket (refer to FIG. 6) fixed on the plate 12, so that the entrance of the introducing path assembly 47 on the wall 40*b* may be positioned to communicate with the bank note discharging slot 25 of the ball Wading machine 20 arranged at the end of the line of game machines.

As shown in FIG. 6, the placement of the introducing path supporting body 60 of the driven unit 50 is also easily adjusted by the connecting guide 64 being slidably placed in the upper installing bracket 55 fixed on the plate 12, so that the entrance of the introducing path assembly 61 provided on the introducing path body 60 may be positioned to communicate with the bank note discharging slot 25 of the ball lending machine 20 arranged at the end of the line of the game machines 11*a*. Further, the placement of the driven unit installing frame 50*a* of the introducing path supporting body 60 is also adjusted by the connecting guide 54 which is slidably placed in the lower installing bracket 56. The round belt 30*a* which circulates in the main conveying direction along the bank note collecting line is placed over the drive pulley 41 and the driven pulley 51.

Means for passing the bank note from the bank note discharging slots 25 of the ball lending machines 20 to the bank note collecting line is provided, so that bank notes out from the bank note discharging slots 25 of the ball lending machines 20 may be brought into contact with the round belt 30*a* to be conveyed in the conveying direction.

In the present invention, a space between the bank note discharging slots 25 of the ball lending machines disposed between the game machines 11 and the bank note collecting line, especially spaces behind the game machines 11 are utilized to install the special unit for guiding the bank note from the bank note discharging slots 25 of the ball lending machines 20 to the bank note collecting line. Thus, the introducing units 80 can be incorporated between the intermediate conveying units 70 which are disposed between the drive unit 40 and the driven unit 50.

On the other hand, the ball lending machine 20 arranged at the end of the island has not a space sufficient to install the special unit for guiding. The introducing path assemblies 47, 61 provided in the drive unit 40 and the driven unit 50, respectively, are used to communicate with the bank note discharging slot 25, of the ball lending machine 20 disposed at the end of the island. Thus, the bank note from the ball lending machines 20 can be sent directly to the round belt 30*a* along the bank note collecting line via the introducing path assembly 47 or 61.

What is claimed is:

1. A game machine island comprising;

a plurality of game machines each having a game plate which faces a player for playing a game by rolling balls on said game plate;

a plurality of ball lending machines each having, on one side thereof, a bank note inlet for receiving a bank note inserted thereinto and a ball discharging slot for dispensing a number of balls in accordance with an amount of bank notes inserted through the bank note inlet and, on another side thereof, a bank note discharging slot for discharging the bank note out of said ball lending machine;

a bank note collecting device for collecting and storing the bank notes inserted into the plurality of ball lending machines; and a bank note conveying device for introducing the bank notes inserted into said ball lending machines to said bank note collecting device;

said plurality of game machines being arranged in a line with their game plates facing in one direction;

said plurality of ball lending machines being disposed between two adjacent game machines and at either end of the line of the game machines with said one side having the bank note inlet and the ball discharging slot facing in the said one direction;

said bank note collecting device being disposed at a position adjacent to one of the ball lending machines arranged at the ends of the line of the game machines;

said bank note conveying device comprising;

an endless belt provided along a main conveying path extending, from another ball lending machine arranged at another end of the line of the game machines to said bank note collecting device, along said plurality of game machines and said plurality of ball lending machines, for conveying a bank note along the main conveying path in contact with either one of faces of the bank note;

a drive unit provided at one end of the main conveying path where said bank note collecting device is arranged, and including a main path end portion forming assembly for forming an end portion of said main conveying path where said bank note collecting device is disposed; an end introducing path forming assembly for forming an introducing path to introduce a bank note from the bank note discharging slot of the ball lending machine to the main conveying path formed by said main path end portion forming assembly; a drive pulley around which said endless belt is placed; and a pulley rotating mechanism for rotating said drive pulley;

a driven unit provided at another end of said main conveying path where said banknote collecting device is not provided, and including a main path end portion forming assembly for forming another end of the main conveying path where said bank note collecting device is not arranged; an end introducing path forming assembly for forming an introducing path for introducing a bank note from the bank note discharging slot of the ball lending machine to the end portion of the main conveying path formed by said main path end portion forming assembly; and a driven pulley around which the endless belt is placed;

an introducing unit for forming an introducing path for introducing the bank note from said ball lending machines disposed between two adjacent game machines to said bank note conveying path; and an intermediate conveying unit having an intermediate conveying path for forming an intermediate portion of said main conveying path between said drive unit and said driven unit.

2. A game machine island according to claim 1, further comprising;

a reference board fixed to a floor at a portion adjoining to said drive unit, and having an installing bracket extending in a direction of said main conveying path;

said drive unit having a connecting guide extending in a direction of said main conveying path, and engageable with said installing bracket, said connecting guide being integrally with, said main path end portion forming assembly and said end introducing path forming assembly; and said connecting guide of said drive unit being fit onto said installing bracket, and said drive unit connected to said reference board being movable in a direction of said main conveying path.

3. A game machine island according to claim 1, further comprising;

a reference board fixed to a floor at a portion adjoining to said driven unit, and having an installing bracket extending in a direction of said main conveying path;

said driven unit having a connecting guide extending in a direction of said main conveying path and engageable with said installing bracket, said connecting guide being formed integrally with, said main path end portion forming assembly and said end introducing path forming assembly; and said connecting guide of said driven unit being fit onto said installing bracket, and said driven unit connected to said reference board being movable in a direction of said main conveying path.

4. A game machine island according to claim 2, further comprising;

a reference board fixed to a floor at a portion adjoining to said driven unit, and having an installing bracket extending in a direction of said main conveying path;

said driven unit having a connecting guide extending in a direction of said main conveying path and engageable with said installing bracket, said connecting guide being formed integrally with said main path end portion forming assembly and said end introducing path forming assembly; and said connecting guide of said driven unit being fit onto said installing bracket, and said driven unit connected to said reference board being movable in a direction of said main conveying path.

5. A game machine island according to claim 1, wherein said intermediate conveying unit has a connecting guide rail extending in a direction of said main conveying path;

said introducing unit has a connecting guide rail extending in a direction of said main conveying path;

said connecting guide of said introducing unit is fit onto said connecting guide of said intermediate conveying unit, and said introducing unit is connected to said intermediate conveying unit movably in a direction of extending said main conveying path.

6. A game machine island according to claim 4, wherein said intermediate conveying unit has a connecting guide rail extending in a direction of said main conveying path;

said introducing unit has a connecting guide rail extending in a direction of said main conveying path;

said connecting guide of said introducing unit is fit onto said connecting guide of said intermediate conveying unit, and said introducing unit is connected to said intermediate conveying unit movably in a direction of extending said main conveying path.

* * * * *